US006478633B1

(12) United States Patent
Hwang

(10) Patent No.: US 6,478,633 B1
(45) Date of Patent: Nov. 12, 2002

(54) CYLINDRICAL TERMINAL RIVET AND BATTERY SNAP

(76) Inventor: Steve Han Shi Hwang, 3F, No. 142, Li-De Street, Chungho City, Taipei Hsien (TW)

( * ) Notice: Subject to any disclaimer, the term of this patent is extended or adjusted under 35 U.S.C. 154(b) by 0 days.

(21) Appl. No.: 09/880,812

(22) Filed: Jun. 15, 2001

(30) Foreign Application Priority Data

May 24, 2001 (TW) ..... 90208534 U

(51) Int. Cl.[7] ..... H01R 4/28

(52) U.S. Cl. ..... 439/754; 439/287; 439/741; 439/500

(58) Field of Search ..... 439/754, 741, 439/500, 287, 759, 627

(56) References Cited

U.S. PATENT DOCUMENTS 1,912,653 A * 6/1933 Olson ..... 29/874
2,990,533 A * 6/1961 Hughes et al. ..... 439/84
4,239,322 A * 12/1980 Gordon, Jr. ..... 439/458
4,295,705 A * 10/1981 Ciliberti, Jr. ..... 439/389
4,812,130 A * 3/1989 Altenschulte et al. ..... 439/84
5,065,283 A * 11/1991 Adachi et al. ..... 361/775
5,312,269 A * 5/1994 Hwang ..... 439/500
5,421,743 A * 6/1995 Hwang ..... 439/500

FOREIGN PATENT DOCUMENTS

GB 2081524 * 2/1982

* cited by examiner

*Primary Examiner*—Tulsidas Patel
*Assistant Examiner*—Michael C. Zarroli
(74) *Attorney, Agent, or Firm*—Troxell Law Office PLLC

(57) ABSTRACT

A cylindrical terminal rivet integrally made of metal includes a base plate, a cylinder, and an elongated plate. The base plate has a central hole and the cylinder with a closed upper end extends from the base plate and communicates with the central hole. The elongated plate extends outwardly from a lateral side of the base plate and has at least a wing piece at two opposite edges. The cylinder is arranged to pass through a work piece and pressed to form a flattened solid body so as to clamp the work piece tightly and to block the central hole. Furthermore, a battery snap can be composed of two cylindrical terminal rivets, an insulation piece, a male engaging post, a female engaging post and a covering band.

5 Claims, 4 Drawing Sheets

CYLINDRICAL TERMINAL RIVET AND BATTERY SNAP

BACKGROUND OF THE INVENTION

1. Field of the Invention

The present invention relates to a terminal rivet, and particularly, to a cylindrical terminal rivet, which can avoid foreign liquids such as the leaked liquid from the battery, passing through the pierced holes therein and can strengthen the torque resistance after engaging with a work piece. Furthermore, the cylindrical terminal rivet can be used for a battery snap.

2. Description of Related Art

The quality of an electronic product usually depends on whether the design of components thereof and the assembly of the components are good or not. Especially, how to properly treat adjoin a so-called contact point or terminal is very important in the electronic industry.

Taking the battery box as an example, although it is not a high precision product, the contact point being unimpeded is a key feature affecting the function and the quality of an electronic product. Actually, it is a primary consideration for the battery box to offer sufficient room for receiving the batteries so that it is not possible for the maker to treat the contact points thereof with a high precision or high cost.

Referring to FIG. 1, a conventional hollow terminal rivet 100 comprises a base plate 101, and the base plate 101 at the center thereof has a hollow rivet post 102 with a cylindrical hole 103 communicating with the base plate 101 so that the entire rivet post 102 can pass through a work piece. Besides, the base plate 101 at a lateral side thereof has an elongated plate 104 with at least a wing piece 105 at both lateral edges for being pressed to join with an electric wire.

As soon as the rivet post 102 of the terminal rivet 100 is inserted into the work piece, the rivet post 102 can be pressed by a press machine to cause radial fracture so as to be expanded into a plurality of post pieces for fixing the work piece together with the base plate 101. The terminal rivet 100 is integrally made of a metal and the cylindrical hole 103 is not blocked after the riveting step. As a result, foreign liquid or liquid leaked from the battery due to a chemical reaction may pass through the cylindrical hole 103 to flow toward the circuit board and damage the electronic product. In addition, the conventional terminal rivet is fixed to the work piece together with the base plate so that inferior quality of clamping may occur and the rivet post becomes rotatable on the work piece. As a result, it leads to an improper contact. Moreover, the post pieces may break and the whole terminal rivet may separate from the work piece.

SUMMARY OF THE INVENTION

An object of the present invention is to provide a cylindrical terminal rivet, which has a cylinder to be compressed to form a flattened solid body to block the engaging hole therein so as to prevent foreign liquid from passing through the hole.

Another object is to provide a battery snap composed of two cylindrical terminal rivets of the present invention such that no liquid can flow through engaging holes to damage the related circuit board.

BRIEF DESCRIPTION OF THE DRAWINGS

The present invention can be more fully understood by referencing to the following description and accompanying drawings, in which.

DETAILED DESCRIPTION OF THE PREFERRED EMBODIMENTS

Figure 1:
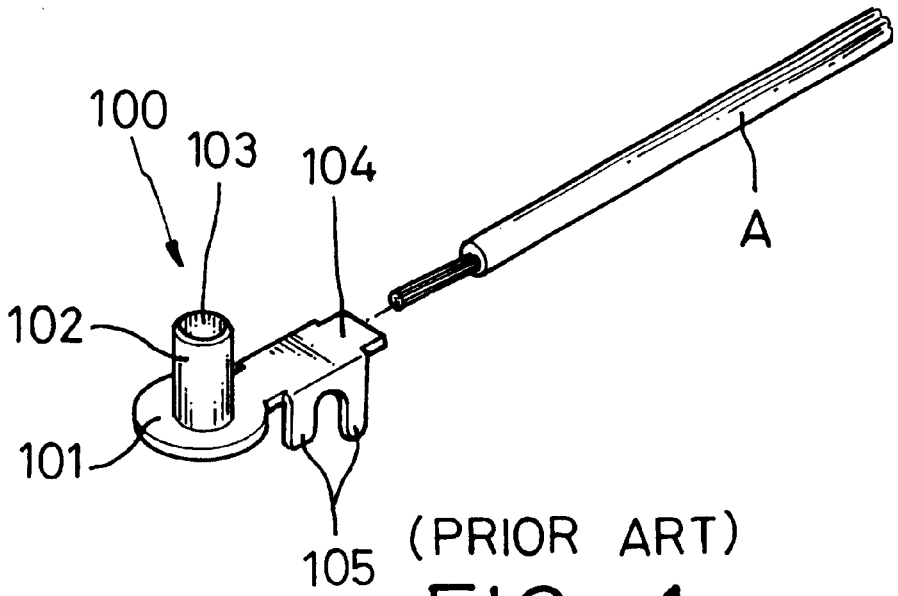
(PRIOR ART) FIG. 1
FIG. 1 is a perspective view of a conventional terminal rivet.
Figure 2:
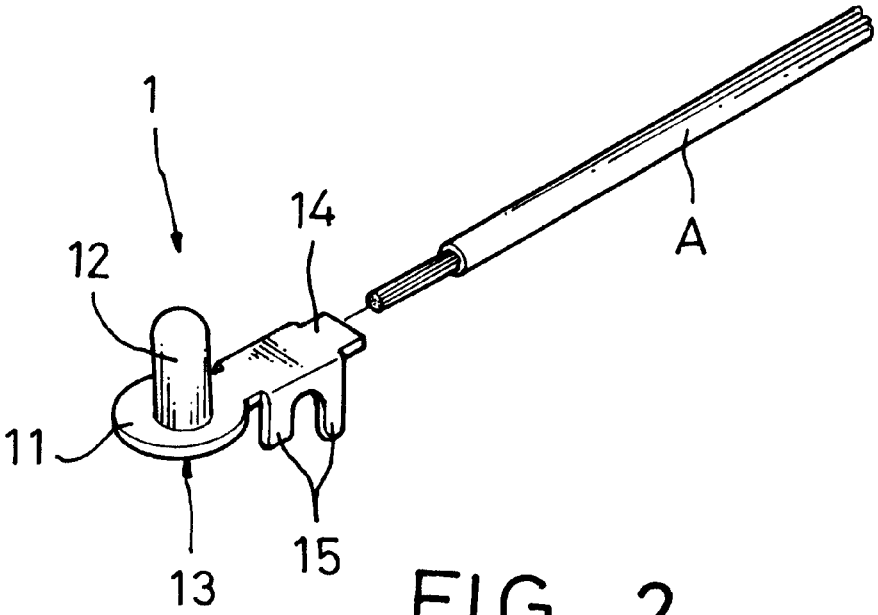
FIG. 2 is a perspective view of a cylindrical terminal rivet according to the present invention.

Referring to FIGS. 1 and 2, a cylindrical terminal rivet 1 is integrally made of a metal and includes a base plate 11 providing an upright cylinder 12 at the center thereof and a laterally extending, elongated plate 14.

The base plate 11 is circular and the upright cylinder 12 has a closed upper end so as to be inserted into a work piece. The base plate 11 has a central hole 13 to communicate with the upright cylinder 12. The elongated plate 14 extending from the base plate 11 has both opposite lateral edges thereof provided with at least a wing piece 15 respectively.

Figure 3:
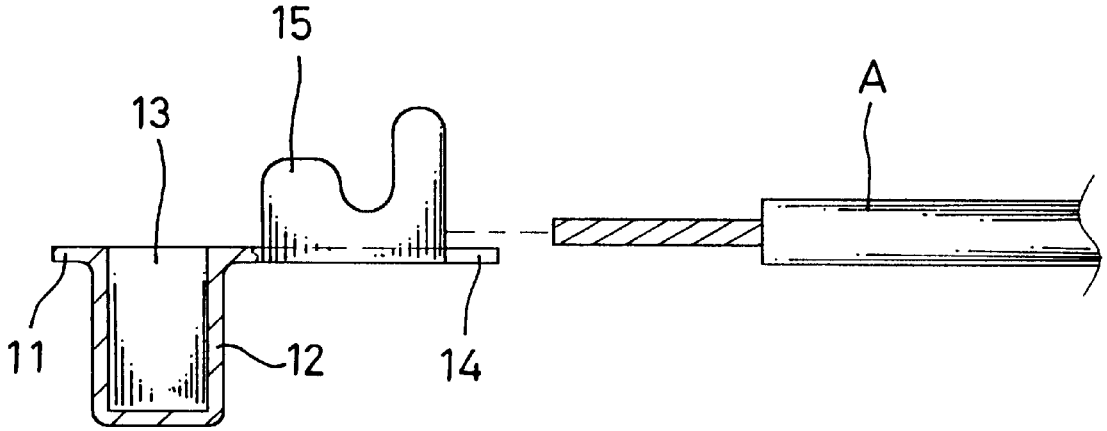
FIG. 3 is a sectional view of the cylindrical terminal rivet shown in FIG. 2.
Figure 4:
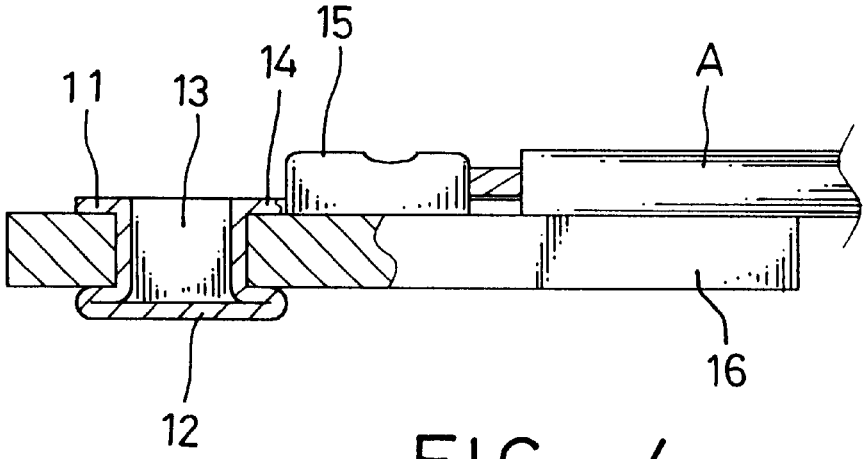
FIG. 4 is a sectional view illustrating the cylindrical terminal rivet engaging after engaging with a work piece.

Referring to FIGS. 3 and 4, and accompanying with FIG. 2 again, as soon as the cylindrical terminal rivet of the present invention is going to be engaged with the work piece 16, a bare electrical wire A is placed on the elongated plate 14 first and then the wing pieces 15 are pressed to clamp the electric wire A tightly. Next, the cylinder 12 is arranged to pass through a preset engaging hole on the work piece 16 such that the cylinder 12 can be pressed to form a circular solid body and surround the engaging hole 13 completely. In this way, the terminal rivet of the present invention can tightly and firmly clamp the work piece between the compressed cylinder 12 and the base plate 11.

It is appreciated that the advantages of the present invention can be summarized hereinafter.

(1) The compressed cylinder with a flattened shape can block the engaging hole such that foreign liquid or liquid from the battery may not spread or flow deeply into the riveted spot. In this way, the liquid can be removed in a very short time to assure the life span of an electronic product.

(2) The compressed cylinder with a flattened shape can clamp the work piece such that a structural strength can be substantially increased. For instance, the conventional hollow terminal rivet shown in FIG. 1 (The height thereof is about 2.5~2.6 mm.) provides a maximum torque resistance of 0.5~0.6 Kgf-cm after an experimental test. Nevertheless, the cylindrical terminal rivet of the present invention with a size being the same as the conventional terminal rivet provides a maximum torque resistance of 1.2~1.3 Kgf-cm. Hence, the cylindrical rivet of the present invention cannot loosen from the work piece easily after being pulled such that an excellent contact can be maintained.

Figure 5:
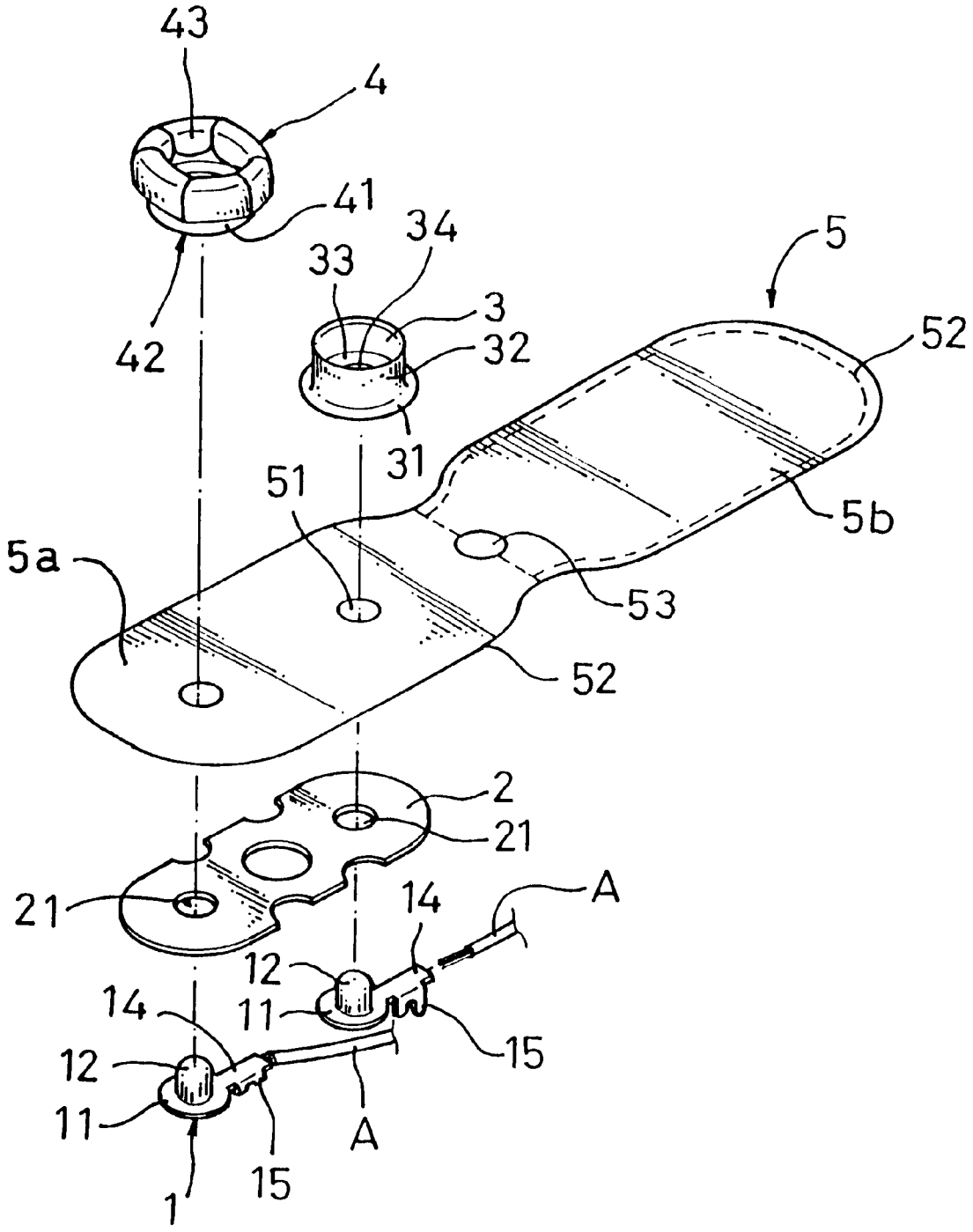
FIG. 5 is an exploded perspective view of a cylindrical terminal rivet of the present invention engaging with a battery snap.
Figure 6:
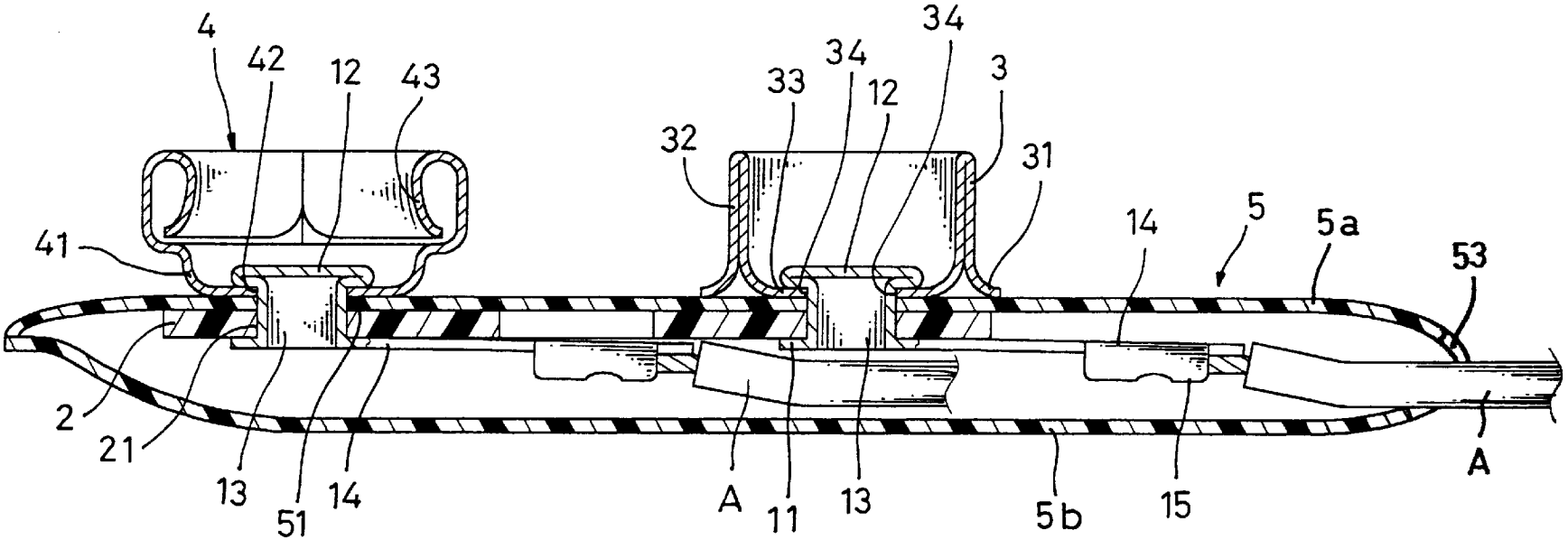
FIG. 6 is a sectional view of FIG. 5 after the cylindrical terminal rivet having engaged with the battery snap.

Referring to FIGS. 5 and 6, the cylindrical terminal rivet used for a battery snap is illustrated. The battery snap comprises two cylindrical terminal rivets 1, an insulation piece 2, a male engaging post 3, a female engaging post 4, and a covering band 5.

The structure of the cylindrical terminal rivet has been described previously so that it would not be repeated.

The insulation piece 2 is an insulation plate with two pole holes 21 corresponding to two poles of the battery respectively for being inserted by the cylinders 12.

The male engaging post 3 is made of a conductive metal and the lower edge thereof has a flange 31 and a cylindrical post 32 extends upward from the lower edge. Also, a lower ring 33 and a central hole 34 surrounded by the lower ring 33 are formed at the lower edge. The cylindrical post 32 has an outer diameter corresponding to a female snap part on the battery with a standard specification. The central hole 34 has a size corresponding to the outer diameter of the cylinder 12 such that the cylinder 12 is flattened to tightly press over the lower ring 33.

The female engaging post 4 is made of a conductive metal and the lower part thereof extends downward forming a bottom 41 with a central hole 42 surrounded by the bottom 41 so as to be engaged by the deformed cylinder 12. The female engaging post 4 at the upper part thereof is folded inwardly to form a plurality of petal parts 43 for engaging with the male snap part of the battery. The size of the male snap part of the battery is made in accordance with the standard specification.

The covering band 5 is insulated and preferably made of a plastic sheet. Pierced holes 51 are provided corresponding to the pole holes 21 for being passed through by the cylinders 12. In order to prevent the insulation piece, the base plate 11 and the elongated plate 14 from actual exposure, the lower part of the covering band 5 is folded forming upper band part 5*a*, lower band part 5*b* affixed at and a border 52 by way of welding such that a fitting hole 53 is left for being passed over by the electric wire A.

Accordingly, the assembled battery snap is shown in FIG. 6 and it can be seen that the male engaging post 3 and the female engaging post 4 at the inner part thereof are engaged by the deformed cylinder 12, which is compressed to form a circular solid piece. The cylinders 12 can block the central holes 34, 42 respectively so as to not admit liquid leaked from the battery entering the interior of the battery snap so that oxidization can be avoided. Furthermore, a torque resistance can be increased due to two cylindrical terminal rivets 1 engaging with the male engaging post 3 and the female engaging post 4 respectively such that the two engaging posts may not become loosened or disengaged from pulling on the battery snap to separate it from the battery.

While the invention has been described with reference to preferred embodiments thereof, it is to be understood that modifications or variations may be easily made without departing from the spirit of this invention, which is defined in the appended claims.

What is claimed is:

1. A cylindrical terminal rivet assembly comprising:

a) a flat piece having opposite facing first and second surfaces and at least one hole therethrough;

b) at least one terminal rivet including a base plate, an upright cylinder extending from the base plate and a laterally extending plate having wing pieces thereon, the upright cylinder passing through the at least one hole in the flat piece and having a closed, flattened deformable end portion whereby the closed, flattened deformable end portion contacts the first surface of the flat piece and the base plate contacts the second surface of the flat piece so as to clamp the flat piece therebetween; and c) an electric wire connected to the laterally extending plate by the wing pieces engaging the electric wire such that the electric wire is on the second side of the flat plate opposite to the flattened deformable end portion of the upright cylinder.

2. The cylindrical terminal rivet assembly of claim 1 wherein the flat piece is an insulation piece.

3. The cylindrical terminal assembly of claim 2 wherein the at least one terminal comprises first and second terminals and the insulation piece includes two pole holes, one of the first and second terminals engaged with one of the two pole holes.

4. The cylindrical terminal rivet assembly of claim 3 further comprising a covering band enclosing the insulation piece, and the base plates and the laterally extending plates of the first and second terminals, the flattened end portions of the first and second terminals located exteriorly of the covering band.

5. The cylindrical terminal rivet assembly of claim 4 further comprising a male engaging post connected to the first terminal and having a lower ring, and a female engaging post connected to the second terminal and having a bottom, the flattened end portion of the first terminal engaging the lower ring and the flattened end portion of the second terminal engaging the bottom, whereby the flattened end portion are located in interiors of the male and female engaging posts.

* * * * *